US008550000B2

(12) United States Patent
Gahan et al.

(10) Patent No.: US 8,550,000 B2
(45) **Date of Patent: *Oct. 8, 2013**

(54) PRINTING PLATE UNLOADING APPARATUS AND METHOD

(75) Inventors: Stuart Michael Gahan, Preston (GB); Tony Hollings, Whalley (GB)

(73) Assignee: Goss Graphic Systems Limited, Preston, Lancashire (GB)

( * ) Notice: Subject to any disclaimer, the term of this patent is extended or adjusted under 35 U.S.C. 154(b) by 1224 days.

This patent is subject to a terminal disclaimer.

(21) Appl. No.: 11/913,638

(22) PCT Filed: May 5, 2006

(86) PCT No.: PCT/EP2006/062105

§ 371 (c)(1),
(2), (4) Date: Oct. 1, 2008

(87) PCT Pub. No.: WO2006/120171

PCT Pub. Date: Nov. 16, 2006

(65) Prior Publication Data

US 2009/0071359 A1 Mar. 19, 2009

(30) Foreign Application Priority Data

May 9, 2005 (GB) ..... 0509424.8

(51) Int. Cl.
*B41F 1/28* (2006.01)
*B41F 1/34* (2006.01)

(52) U.S. Cl.
USPC ..... 101/415.1; 101/383; 101/477; 101/485

(58) Field of Classification Search
USPC ..... 101/374, 382.1, 383, 415.1, 477, 101/485, 486
See application file for complete search history.

(56) References Cited

U.S. PATENT DOCUMENTS 3,892,178 A 7/1975 Staamann
4,683,822 A 8/1987 Sardella et al.

(Continued)

FOREIGN PATENT DOCUMENTS

DE 4219822 A1 12/1993
DE 19639973 A1 5/1997

(Continued)

OTHER PUBLICATIONS

Patent Abstracts of Japan, JP 2000062146 (Mitsubishi heavy Ind. Ltd.), Feb. 29, 2000, 1 pg.

(Continued)

*Primary Examiner* — Ren Yan
(74) *Attorney, Agent, or Firm* — Lando & Anastasi, LLP

(57) ABSTRACT

Apparatus for removing printing plates (8) having leading and trailing edges located in a lock-up slot in a plate cylinder (2) of a rotary printing press, from said plate cylinder (2) is disclosed. The apparatus comprises means for extracting the trailing edge from a lock-up slot which is also operable to partially extract the leading edge from a lock up slot. The apparatus further includes an extraction member for engaging, as the printing cylinder rotates, a portion of the leading edge (8*a*) of the printing plate protruding from the lock up slot (9) following its partial extraction, to complete the removal of the printing plates from the printing cylinder and leave the removed plates, hanging by their leading edge (8*a*), on the extraction member. A method of loading printing plates onto a plate cylinder (2) is also disclosed.

19 Claims, 7 Drawing Sheets

(56) References Cited

U.S. PATENT DOCUMENTS

| | | | | |
|---|---|---|---|---|
| 4,727,807 | A | 3/1988 | Suzuki et al. | |
| 4,858,528 | A | 8/1989 | Inouye et al. | |
| 4,878,407 | A | 11/1989 | Harrison et al. | |
| 5,012,735 | A | 5/1991 | Fischer et al. | |
| 5,074,212 | A | 12/1991 | Kobler et al. | |
| 5,111,744 | A | 5/1992 | Wieland | |
| 5,127,328 | A | 7/1992 | Wieland | |
| 5,540,151 | A | 7/1996 | Ruckmann et al. | |
| 5,595,119 | A | 1/1997 | Hada et al. | |
| 5,671,674 | A | 9/1997 | Nobuta et al. | |
| 5,701,822 | A | 12/1997 | Metrope | |
| 5,758,579 | A * | 6/1998 | Marmin et al. | 101/486 |
| 6,199,280 | B1 * | 3/2001 | Schneider et al. | 29/895.211 |
| 6,510,795 | B1 | 1/2003 | Detmers et al. | |
| 6,571,708 | B1 | 6/2003 | Rudzewitz et al. | |

FOREIGN PATENT DOCUMENTS

| | | | |
|---|---|---|---|
| DE | 19719559 | A1 | 11/1998 |
| DE | 19549707 | B4 | 3/2005 |
| EP | 0 431 715 | B1 | 3/1995 |
| EP | 0678382 | B1 | 10/1995 |
| EP | 0 924 070 | A1 | 6/1999 |
| EP | 1149694 | A1 | 10/2001 |
| EP | 1 391 299 | A1 | 2/2004 |
| EP | 1 435 292 | A1 | 7/2004 |
| EP | 1435291 | A1 | 7/2004 |
| EP | 1 464 492 | A2 | 10/2004 |
| GB | 2403688 | A | 1/2005 |
| GB | 2413530 | A | 11/2005 |
| JP | 7290689 | A | 11/1995 |
| JP | 8142306 | A | 6/1996 |
| JP | 2000512932 | A | 10/2000 |

OTHER PUBLICATIONS

International Search Report for PCT/GB2005/050059 mailed Nov. 11, 2005, 6 pgs.

Written Opinion of the International Searching Authority mailed Nov. 16, 2006, pp. 12.

International Search Report for PCT/EP2006/062105 mailed Nov. 16, 2006, pp. 7.

Written Opinion of the International Searching Authority for PCT/EP2006/016325 mailed Oct. 2, 2006, pp. 5.

International Search Report for PCT/EP2006/016325 mailed Oct. 2, 2006, pp. 5.

* cited by examiner

PRINTING PLATE UNLOADING APPARATUS AND METHOD

This application is a National Stage Application under 35 U.S.C. §371 from PCT/EP2006/062105, filed May 5, 2006, which claims priority under 35 U.S.C. §119(a)-(d) to United Kingdom Application No. GB 0509424.8, filed on May 9, 2005, both of which are hereby incorporated by reference.

BACKGROUND OF THE INVENTION

The present invention relates to apparatus for unloading printing plates from the plate cylinder of a rotary offset printing press and, to an apparatus that can also be used to assist in the loading of those plates onto the plate cylinder of the press. More specifically, it relates to an apparatus for the semi-automatic loading and unloading of printing plates. The present invention also relates to means for checking whether a printing plate position on the plate cylinder is occupied by a printing plate and for notifying an operator of the outcome of this check.

A web offset printing press comprises a number of printing units. Each unit is designed to print matter onto a continuous web of paper as it travels through the print unit. The printed web emerging from each print unit come together in a folding unit which orientates, folds and cuts each web to produce the finished article such as a newspaper or magazine. Each unit contains at least one pair of cylinder groups or print couples comprising a rotatably mounted plate cylinder, to which one or more printing plates are attached and, a rotatably mounted blanket cylinder. The printing unit may incorporate a shaft less drive system in which each cylinder group is driven by its own drive motor that directly drives one of the cylinders of a group via a belt or gear drive and the other cylinder of that group is mechanically coupled to the driven cylinder. An inking system associated with each print couple is operable to feed ink onto the printing plates attached to the plate cylinder as the plate cylinder rotates. As the cylindrical surfaces of the plate and blanket cylinder are in rolling contact, an inked image is transferred from the printing plates onto the blanket cylinder and from the blanket cylinder onto the medium to be printed.

In large scale high volume presses used, for example, in the production of newspapers, multi-colour printing is achieved by providing each print unit with a number of printing couples arranged in pairs which are mounted vertically above one another in a stack so that the paper web travels in a vertically upward direction between each pair of print couples. A unit having four print couple pairs, i.e. eight print couples, is able to print up to four colours on each side of the paper web and is often referred to as a "four-high" unit.

When a press is prepared for a print run, at least one printing plate carrying the image to be printed must be firmly clamped to the plate cylinder of each print couple. Generally, the plate cylinder includes at least one recess or lock-up slot extending longitudinally along the surface of the plate cylinder and into which is received the leading and trailing edge of a printing plate. A clamping mechanism located in the recess engages the leading and trailing edges of an inserted printing plate and firmly holds the printing plate in position during a print run. The number of printing plates that must be attached to the plate cylinder of each print couple depends on the width of the press and whether the plate cylinder carries one or two printing plates around its circumference, i.e. whether it is a "one around" or "two around" plate cylinder. For example, in a double width one-around press, the plate cylinder may carry four printing plates across its width and one printing plate extending circumferentially around its cylindrical surface. Therefore, there could be as many as eight printing plates in a single printing couple pair and thirty-two printing plates in a four high printing unit all of which must be replaced before a new print run can be initiated. When the plate cylinder is of the "two-around" type, the number of printing plates is doubled accordingly. Therefore, it will be appreciated that even in the production of just one newspaper issue, a very large number of printing plates will be required.

It is of utmost importance to ensure that all the printing plates attached to one plate cylinder are located in very precise circumferential and lateral registration with respect to each other. It will also be appreciated that as ink of a different colour is applied to the print medium as it passes through each print couple pair of a print unit, it is also important that the printing plates are in alignment with the printing plates attached to each of the other plate cylinders of the press as any misalignment of a printing plate will result in mis-registration of the different coloured inks applied to the print medium which will reduce the quality of the final print.

To enable accurate location of the printing plates, precise detection and confirmation of the position of each printing plate must be determined during installation onto the plate cylinder. A commonly known method of aligning a printing plate on a plate cylinder and to make sure that it is located in an "in-register" position is to provide the leading edge of each plate with a number of slots that locate on pins in the recess in the plate cylinder into which the leading edge of the printing plate is received when it is attached to a plate cylinder. The position of the slots and pins are predetermined so that, when the pins have been located in the slots, the printing plate is in the correct position and the press operator can be confident that the printing plate will be positioned correctly in relation to other printing plates.

In a conventional printing machine, the press operator loads both the leading and trailing edges of each printing plate onto the plate cylinders manually so that they are accurately located in their predetermined in-register positions. However, it will be appreciated that this activity is very labour intensive and time consuming especially when a large number of printing plates need to be replaced. It also means that the press, or at least individual print units, are rendered inoperable for an extended period of time and this has a significantly detrimental affect on the overall productivity of the press.

In an attempt to reduce the setting-up time, attempts have been made to automate or partially automate the plate loading process in which printing plates are automatically fed onto, and accurately located on, the plate cylinder by a printing plate feeding mechanism attached to the printing unit. In such systems, the press operator either accurately positions the printing plates in printing plate holders fixed to the printing press adjacent to each of the plate cylinders of the press or, the position of the printing plates is established by position sensors or similar devices whilst the plates are fed onto the plate cylinder. It is also known from the Applicant's own co-pending GB application no. 0409594.9, which has been published as GB2413530, to provide an improved automatic printing plate loading system that enables printing plates to be pre-positioned in an off-press location and then brought to the press and loaded onto the plate cylinders whilst their "in-register" positions are maintained. This application also describes a fully automatic plate loading module for lifting plates from their holder and loading them onto the plate cylinders of the press. The plate-loading module described in the above-mentioned application can also be used to automatically remove used plates from the plate cylinders of the press.

Conventional automatic plate loading systems, such as those described above, are relatively complicated in their construction and the present application seeks to address this issue by providing a semi-automatic system for unloading printing plates from the plate cylinders of a press that although still involves operator input, significantly increases the speed and ease by which printing plates may be accurately and efficiently unloaded from the printing plate cylinders of a printing press. The apparatus of the invention also assists the operator during the plate loading process. The apparatus of the present invention therefore overcomes many of the problems associated with manual plate loading procedures and avoids the need for complicated detection and position sensing equipment for detecting the position of the printing plates that is required by automatic and many of the conventional semi-automatic plate loading systems currently available.

SUMMARY OF THE INVENTION

According to the present invention, there is provided apparatus for removing one or more printing plates each having leading and trailing edges located in a lock-up slot in a plate cylinder of a rotary printing press, from said plate cylinder, the apparatus comprising means for partially extracting the leading edge of a printing plate from a lock up slot subsequent to extraction of the trailing edge of the printing plate from its lock up slot and, an extraction member for engaging, as the printing cylinder rotates, a portion of the leading edge of the printing plate protruding from the lock up slot following its partial extraction, to complete the removal of the printing plate from the printing cylinder and leave the removed plate, hanging by its leading edge, on the extraction member.

Preferably, the means for partially extracting the leading edge of a printing plate from its lock up slot is also operable to extract the trailing edge of a printing plate from its lock up slot prior to partial extraction of the leading edge.

The means for partially extracting the leading edge from its lock-up slot, and the means for extracting the trailing edge from its lock up slot, may comprise a plate loading/unloading head which may be lowered from a raised position onto the plate cylinder, the plate loading/unloading head including gripping means for gripping printing plates located on the plate cylinder when the print loading/unloading head is lowered onto the plate cylinder.

The plate loading head may advantageously be configured so that it returns to its raised position whilst gripping printing plates on the plate cylinder so as to extract the trailing edge of the printing plate from a lock up slot.

In a preferred embodiment, the plate loading head is configured so that it stops at an intermediate position when returning from its lowered position when gripping printing plates on the plate cylinder so as to partially extract the leading edge of the printing plate from a lock up slot.

Ideally, the plate loading head is configured so that the gripping means releases the printing plate when the intermediate position has been reached.

The apparatus of the invention preferably includes means for indexing the plate cylinder to a position in which the lock up slot containing the printing plate trailing edge is located substantially beneath the plate loading/unloading head for extraction of said trailing edge from the lock up slot and, indexing the plate cylinder once the trailing edge of said printing plates have been removed from said lock up slot so that the printing plate hangs down over the extraction bar and its partially extracted leading edge is removed from its lock up slot by the extraction bar as the lock up slot approaches and rotates past the extraction bar.

In a preferred embodiment, the gripping means comprises a plurality of suction cups.

Preferably, the extraction member comprises a fixed bar extending across the width of the plate cylinder adjacent to its surface.

The extraction bar preferably includes a lip upstanding from an edge thereof to engage the partially extracted leading edge of printing plates and fully extract the leading edge from the plate cylinder to complete the removal of the printing plates from the plate cylinder.

The apparatus of the invention may also be configured to insert the trailing edge of printing plates into a lock up slot of a plate cylinder subsequent to manual insertion of the leading edge, the plate loading/unloading head including a pusher element movable between retracted and extended positions to deflect the trailing edge of printing plates held by the suction cups toward the plate cylinder, when the plate loading head is in a raised position, so that the deflected edge slides into the trailing edge lock-up slot when the suction is released or, when the plate loading head is lowered from its raised position back onto the plate cylinder.

The apparatus preferably also includes a pressure nip for applying pressure to the printing plates to ensure that their leading and/or trailing edges are fully inserted into the lock up slots of the plate cylinder, as the plate cylinder rotates. The pressure nip can be provided by the plate to blanket cylinder nip when on impression or alternatively by a separate pressure roller which may be selectively positioned in or out of rolling engagement with the surface of the plate cylinder.

According to the invention, there is also provided a method of removing one or more printing plates each having leading and trailing edges located in a lock-up slot in a plate cylinder of a rotary printing press, from said plate cylinder, comprising the steps of:

(a) extracting the trailing edge of the printing plates from a lock-up slot of a plate cylinder;

(b) partially extracting the leading edge from a lock up slot of a plate cylinder and, (c) rotating the plate cylinder so that an extraction member engages a portion of the leading edge of the printing plate protruding from the lock up slot following its partial extraction, to remove of the printing plate from the plate cylinder and leave the removed plate, hanging by its leading edge, on the extraction member.

Step (a) preferably includes the step of indexing the plate cylinder so that the lock up slot containing the trailing edge of each printing plate is located substantially beneath a plate loading/unloading head, lowering the plate loading head towards the plate cylinder, activating gripping means on the plate loading head to grip the printing plates and raising the plate loading head to extract the trailing edge of the printing plates from the lock up slot.

In one embodiment, step (b) includes the steps of indexing the plate cylinder so that the lock up slot containing the leading edge of the each printing blanket is located substantially beneath the plate loading/unloading head, lowering the plate loading/unloading head towards the plate cylinder, activating gripping means on the plate loading head to grip the printing plates and raising the plate loading head to an intermediate position in which the leading edge of the printing plates is partially extracted from the lock up slot.

If the plate loading/unloading head is also configured to insert the trailing edge of printing plates into a lock up slot of a plate cylinder subsequent to manual insertion of the leading edge, the method may also include the steps of manually inserting the leading edge of printing plates into the leading edge lock-up slot and indexing the plate cylinder so that the trailing edge is located substantially below the plate loading/unloading head, releasing the suction or, lowering the plate loading head and activating the gripping means to grip the printing plates, raising the plate loading head and activating a pusher element to deflect the trailing edge of the printing plates towards the plate cylinder, lowering the plate loading head so that the trailing edge of the printing plates slide into the trailing edge lock-up slot.

The step of indexing the plate cylinder prior to insertion of the trailing edge of the plate cylinders into the lock up slot preferably includes the step of pressing the manually inserted leading edge of the printing plates into their lock up slot using a pressure roller in engagement with the plate cylinder to ensure that the leading edge is fully inserted into its lock-up slot.

In a preferred embodiment, the method includes the step of indexing the plate cylinder after insertion of the leading edge of the plate cylinders into the lock up slot so that the trailing edge passes beneath a pressure roller in engagement with the plate cylinder to ensure the trailing edge is fully inserted into its lock-up slot.

The method may also include the step of moving the blanket cylinder surface or a pressure roller into engagement with the plate cylinder to press the leading and/or trailing edge into the lock up slot.

A potential problem with semi-automatic or automatic plate loading/unloading devices is that it is desirable to know at any moment in time whether each printing plate position on a plate cylinder is occupied by a printing plate. Therefore, an aspect of the present invention also relates to means for checking whether a printing plate is located in a printing plate position on a plate cylinder and for informing the operator as to the result of that check.

Therefore, according to another aspect of the invention, there is provided a rotary web-offset printing press including a plate cylinder defining a plurality of individual printing plate positions thereon and apparatus for removing printing plates from said individual printing plate positions or, for locating printing plates in said individual printing plate positions, the apparatus including a discrete vacuum circuit associated with each individual printing plate position so that a negative pressure is generated within a vacuum circuit associated with an individual printing plate position when that vacuum circuit is closed by the presence of a printing plate in that individual printing plate position, wherein the plate cylinder is configured so that closure of a vacuum circuit and generation of a negative pressure is prevented when no printing plate is present in an individual printing plate position on the plate cylinder, the press including means for detecting the generation of negative pressure in each vacuum circuit and for providing information relating to the outcome of that detection to an operator to enable the presence of a printing plate in each individual printing plate position to be determined.

In a preferred embodiment, the press includes a controller to rotate the plate cylinder into a predetermined position to facilitate the removal of printing plates from said individual printing plate positions, or for locating printing plates in said individual printing plate positions, using the apparatus.

Preferably, each vacuum circuit is in communication with at least one suction cup operable to contact a printing plate present in an associated individual printing plate position on the plate cylinder or, to contact the plate cylinder when no printing plate is present in said associated individual printing plate position.

The plate cylinder may be configured so as to vent the vacuum circuit associated with an individual printing plate position to the atmosphere when a suction cup associated with said vacuum circuit contacts the plate cylinder when no printing plate is present in said associated printing plate position, thereby preventing closure of said vacuum circuit and the generation of a negative pressure.

The plate cylinder preferably includes a plurality of vents formed therein and having an inlet located in the surface of the plate cylinder in a region contacted by the suction cups when no printing plate is present and the plate cylinder is in its predetermined position.

The plate cylinder may have a lock-up slot to receive the leading and/or trailing edge of the printing plates and each vent has preferably has an outlet in the lock up slot.

The present invention also provides a method of determining the presence of a printing plate in a plurality of individual printing plate positions on a plate cylinder of a rotary web-offset printing press comprising apparatus for removing printing plates from said individual printing plate positions or, for locating printing plates in said individual printing plate positions, the apparatus including a discrete vacuum circuit associated with each printing plate position so that a negative pressure is generated within a vacuum circuit associated with an individual printing plate position when that vacuum circuit is closed by the presence of a printing plate in an individual printing plate position, and the closure of a vacuum circuit and generation of a negative pressure is prevented when no printing plate is present in an individual printing plate position, the method including the step of detecting whether a negative pressure is generated within a discrete vacuum circuit associated with each individual printing plate position and for supplying information relating to the result of that detection to an operator.

BRIEF DESCRIPTION OF THE DRAWINGS

Embodiments of the invention, will now be described, by way of example only, and with reference to the accompanying drawings, in which.

DETAILED DESCRIPTION OF THE INVENTION

Figure 1:
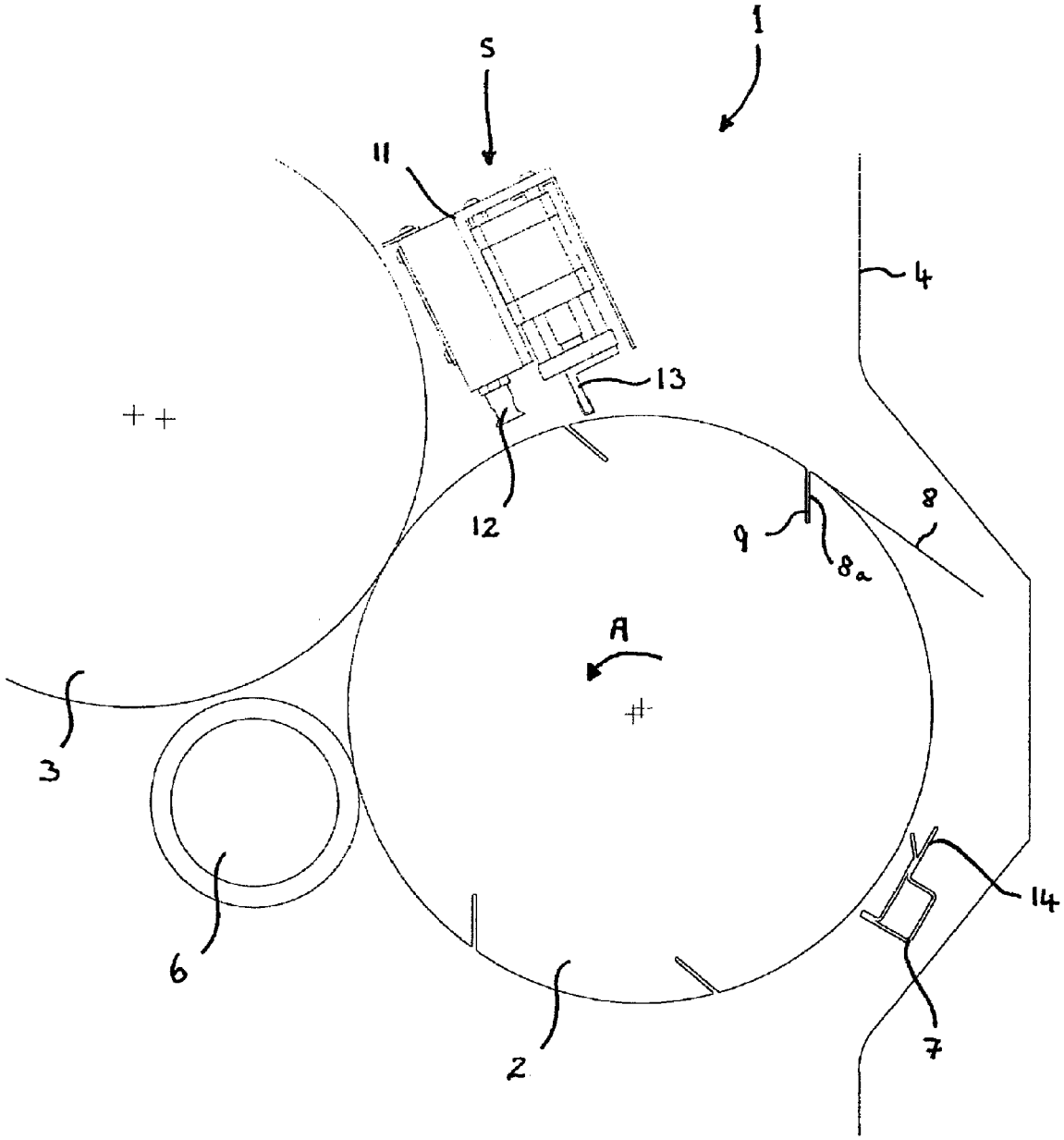
FIG. 1 is a schematic side sectional view through a portion of a print unit of a rotary off-set printing press in which can be seen a plate cylinder, part of a blanket cylinder of one print couple and the plate loading apparatus of the invention including a plate loading head.
Figure 2:
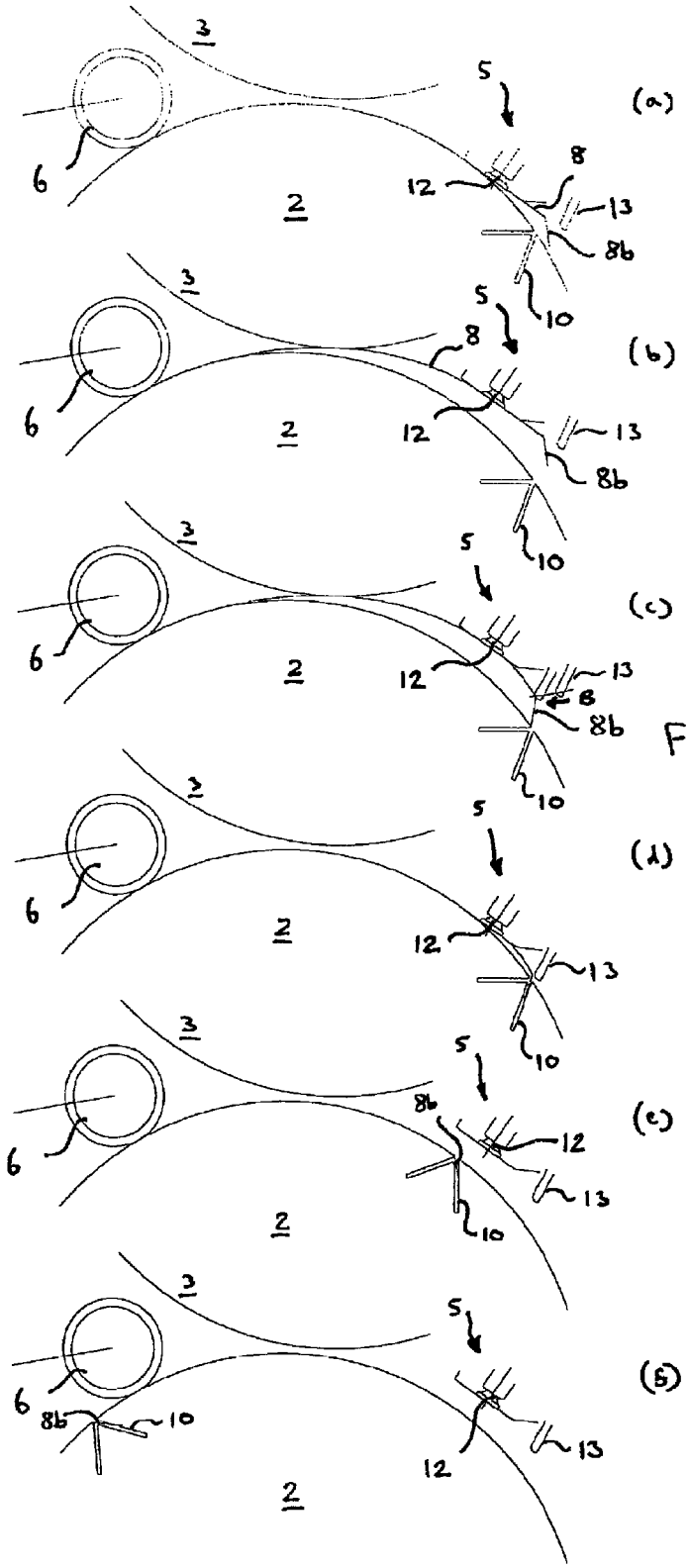
FIG. 2*a* to 2*f* is a sequence of drawings to illustrate how the apparatus of the invention may be used to assist in the printing plate loading procedure and, more specifically to insert the trailing edge of a printing plate into its corresponding lock-up slot.
Figure 3:
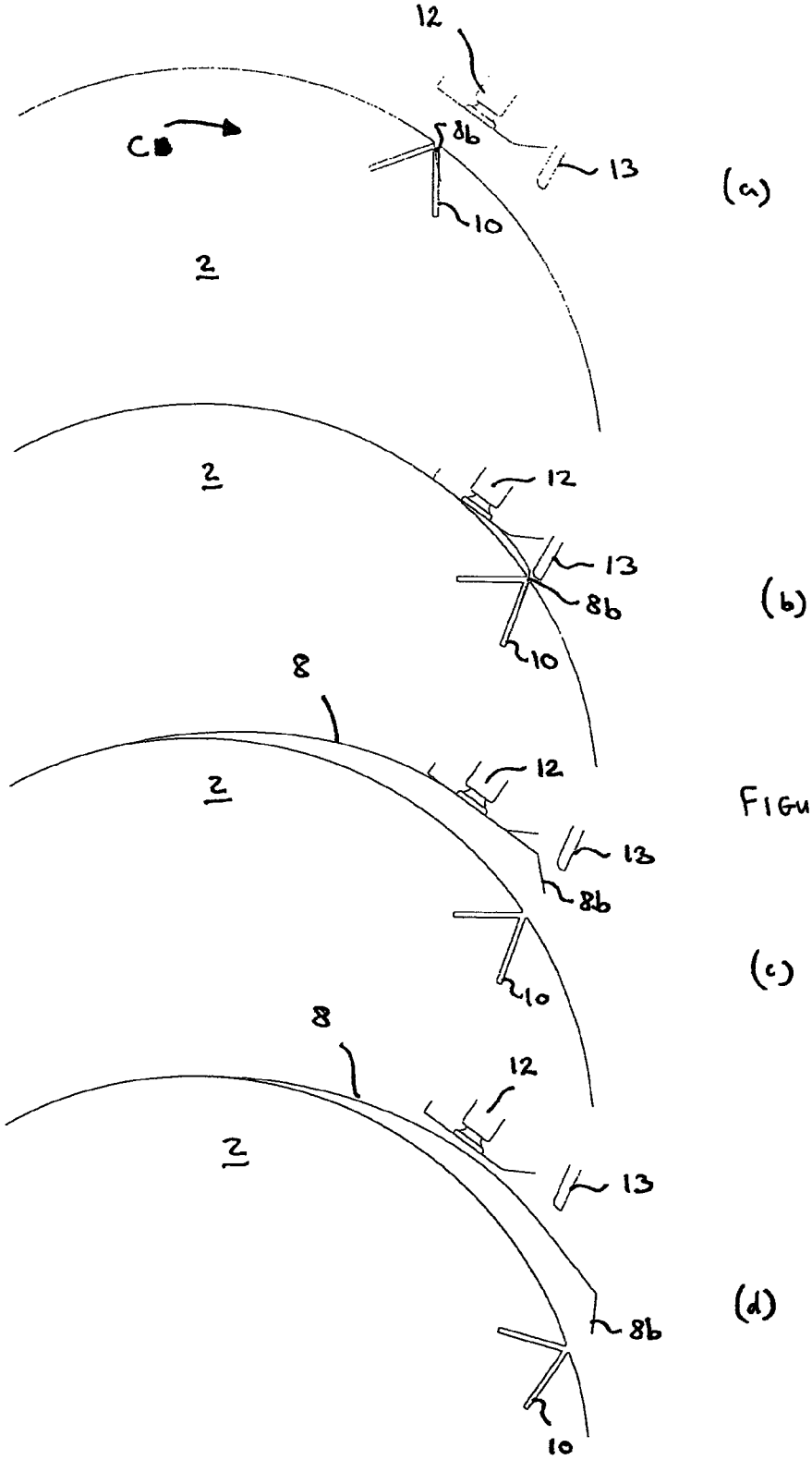
FIG. 3*a* to 3*d* is a sequence of drawings to illustrate how the apparatus of the invention may be used to remove the trailing edge of the printing plate from the lock up slot in which it is inserted.
Figure 4:
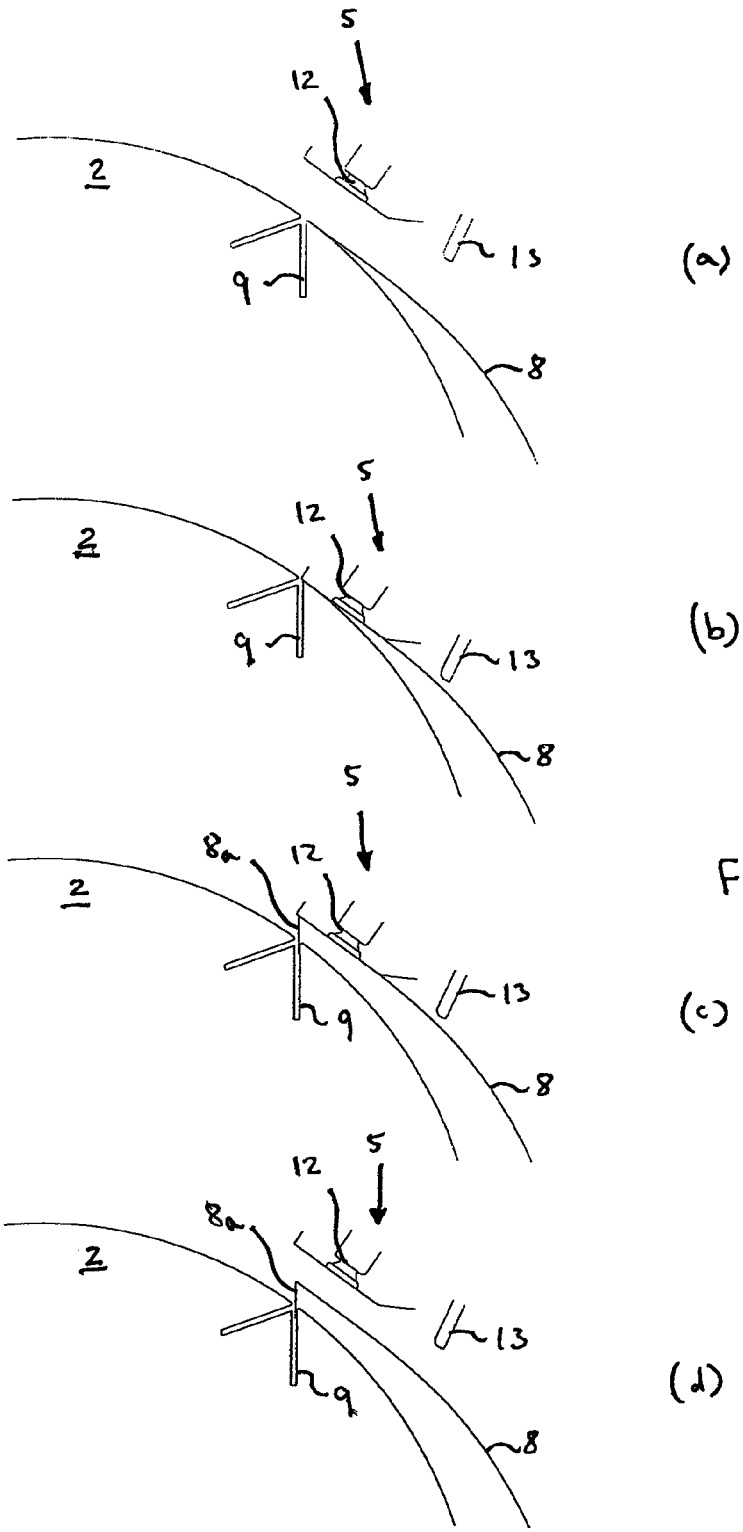
FIG. 4*a* to 4*d* is a sequence of drawings to illustrate how the apparatus of the invention may be used to partially remove the lead edge of a printing plate from the lock-up slot in which it was manually inserted during a loading procedure.
Figure 5:
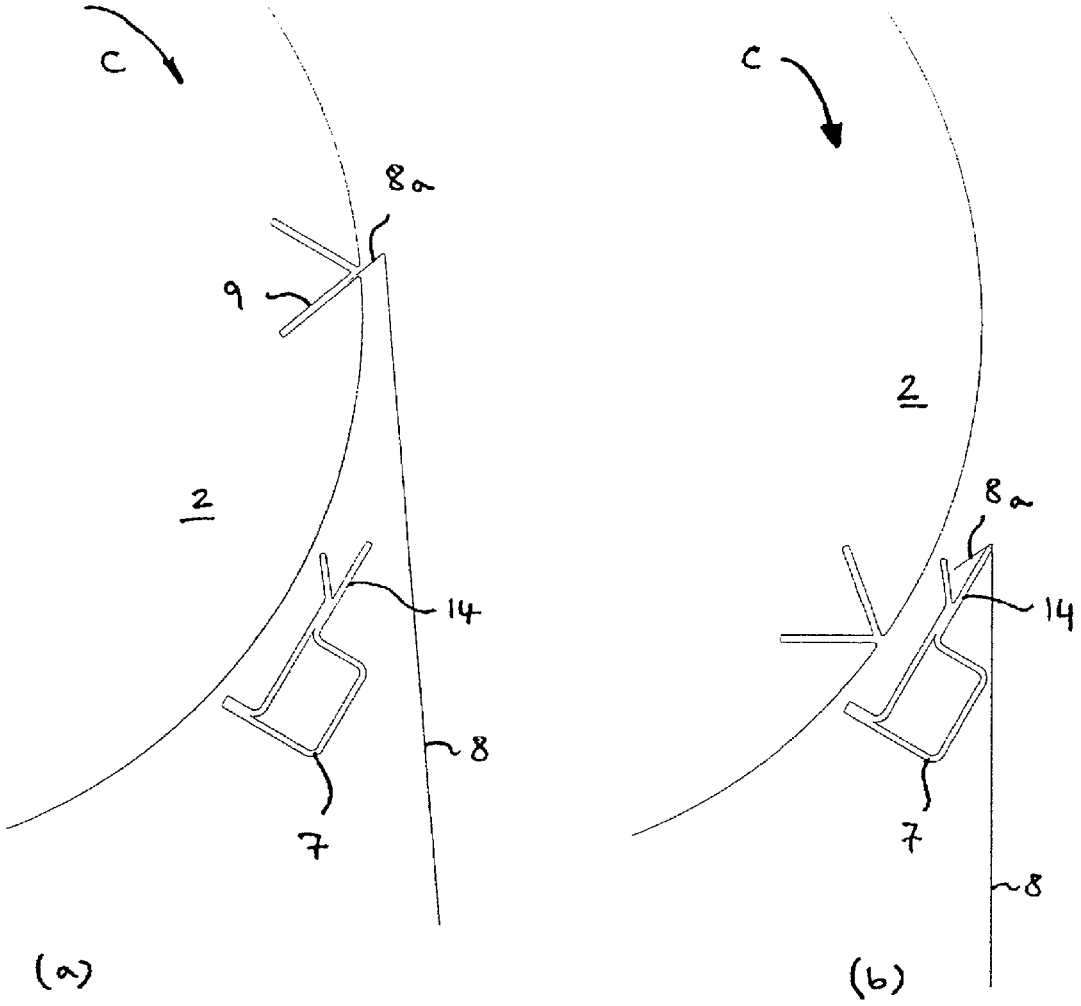
FIGS. 5*a* and 5*b* shows how the printing plate, with its lead edge partially removed from its corresponding lock-up slot, is stripped off the plate cylinder using the stripper bar.

Referring now to the drawings, there is shown in FIG. 1 a side-sectional view of a portion of printing unit 1 of a rotary web offset printing press according to an embodiment of the invention showing the plate and blanket cylinders 2,3 of one cylinder group or print couple mounted within a frame 4. As already explained above, each print unit 1 of the press includes multiple cylinder groups. As each cylinder group is the same as that shown in FIG. 1, it is sufficient for understanding of the invention for only one such group to be illustrated and described in detail.

The plate loading apparatus of the invention comprises three main components mounted around each plate cylinder 2 namely, a plate loading/unloading head 5, a pressure roller 6 and, a static plate leading edge extraction bar or "stripper" bar 7. The plate loading/unloading head 5 can be moved using air cylinders (not shown) between a raised position in which it is spaced away from the plate cylinder when no plate unloading or loading operations are being performed and the printing unit 1 is in use and, a lowered position for carrying out plate loading or unloading operations on the plate cylinder 2. It will be appreciated that, for a complete 4 high printing tower, 8 sets of assemblies are required, one for each print couple. The plate loading/unloading head 5 also has an intermediate position, between the raised and lowered positions, to facilitate the removal of used printing plates 8 from the plate cylinder 2 and, more specifically, the extraction of the lead edge 8*a* of each printing plate from the lock-up slot 9 in which it is inserted, as will be explained in more detail below.

The plate loading/unloading head 5 includes an elongate support frame 11 that extends substantially across the entire width of the plate cylinder 2. An array of suction cups 12 are mounted to and depend from the support frame 11 so as to face the plate cylinder 2 and, when activated, are operable to engage the surface of a set of printing plates to enable the printing plates 8 to be manipulated by the plate loading/unloading head 5. The plate loading/unloading 5 head also includes a pusher element 13 depending from the support frame 11 adjacent to and in the same direction as the suction cups 12. The pusher element 13 is independently movable relative to the support frame 11 and to the suction cups 12 in a direction towards and away from the plate cylinder 2.

In a preferred embodiment of the invention, the pressure roller 6 is separate to the plate loading/unloading head 5 and also extends across the length of the plate cylinder 2. The pressure roller 6 may also be moved into and out of engagement with the plate cylinder 2 and rotates together with the plate cylinder 2 when in engagement therewith. The pressure roller 6 or the plate cylinder 2 to blanket cylinder 3 impression nip ensures that the leading and trailing edges 8*a*,8*b* of any printing plates 8 located on the plate cylinder 2 are pushed fully home into their lock-up slots 9,10.

The extraction bar 7, extends across the width of the plate cylinder 2 close to, but spaced from, the surface thereof for reasons that will become apparent. The position of the extraction bar 7 is fixed and it has a lip or upwardly depending wall 14 upstanding from an upper longitudinally extending edge.

The function and operation of the above-described components will be understood from a description of the procedures involved in the loading of one or more printing plates 8 onto, or the removal of one or more printing plates 8 from, the plate cylinder 2 and this now follows with reference to FIGS. 2 to 5 of the accompanying drawings.

The print unit 1, or at least the pair of print couples for which the printing plates are to be loaded, are taken off-line. The plate cylinder 2 is then indexed forward by rotating it in the direction of arrow "A", as shown in FIG. 1, so that the lock-up slot 9 for the leading edge 8*a* of the printing plate 8 is accessible to the operator. This position is generally indicated by the position of the plate cylinder 2 in FIG. 1. The lead edge 8*a* of the printing plates are now manually inserted into their lock up slots in the correct positions as guided by positioning pins in the slot and corresponding slots in the lead edge of the printing plate, as is conventional. Rotation of the plate cylinder in the direction of arrow "A" is then continued to wrap the printing plates 8 around the plate cylinder 2 and so that the lead edge 8*a* and lock-up slot 9 passes beneath the plate loading/unloading head 5 and beneath the pressure roller 6 which is in a lowered position so that it lies in contact with the surface of the plate cylinder 2. As the lead edge 8*a* passes beneath the pressure roller 6, pressure is applied to it by the pressure roller 6 to ensures that the lead edge 8*a* of the printing plate is pushed fully "home" into its lock up slot 9.

The plate cylinder continues to rotate until the lock-up slot 10 to receive the trailing edge 8*b* of the printing plate 8 is positioned substantially below the trailing edge 8*a* of the printing plate 8 which has now been fully wrapped around the plate cylinder 2, as shown in FIG. 2*a*. Next, the plate loading/unloading head 5 is lowered so that the suction cups 12 come into contact with the surface of the printing plate 8 adjacent to the trailing edge 8*b*, as also shown in FIG. 2*a*. The suction cups 12 are then activated to grasp the printing plate 8 and the plate loading/unloading head 5 is raised so as to lift the trailing edge 8*b* of the printing plate 8 off the plate cylinder 2, as shown in FIG. 2*b*. The pusher element 13 is then activated so that it moves in the direction indicated by arrow "B" so as to deflect the trailing edge 8*b* of the printing plate 8 inwardly towards the plate cylinder 2, as shown in FIG. 2*c*, and the plate loading/unloading head is then lowered again or the suction deactivated so that the trailing edge 8*b* of the plate 8 drops into its lock-up slot 10, as shown in FIG. 2*d*. The suction cups 12 are then deactivated to release the printing plate 8, the pusher element 13 is retracted and the plate loading/unloading head 5 is fully raised, as shown in FIG. 2*e*. Rotation of the plate cylinder 2 is then continued so that the trailing edge lock-up slot 10 passes beneath the pressure roller 6 to ensure that the trailing edge 8*b* of the printing plate is pushed fully "home" within its trailing edge lock-up slot 10, as shown in FIG. 2*f* The pressure roller 6 is then retracted out of contact with the plate cylinder 2. The loading process is now complete and the printing couple may now be placed back on-line and a print run initiated.

The procedure for unloading printing plates 8 from the plate cylinder 2 will now be described. Removal of the trailing edge 8*b* of the printing plates 8 is essentially the reverse of the loading sequence. The plate cylinder 2 is initially indexed so that the trailing edge lock-up slot 10 is positioned close to the plate loading/unloading head, by rotating it in the direction of arrow "C" in FIG. 3*a*, so that it is once again in the same position as shown in FIG. 2*a*. The plate loading/unloading head 5 is subsequently lowered into contact with the upper surface of the printing plate 8 adjacent to its trailing edge 8*b* and the suction devices are then activated, as shown in FIG. 3*b*. The plate loading/unloading head 5 is then lifted so as to pull the trailing edge 8*b* of the printing plate 8 out of the lock-up slot 10, as shown in FIG. 3*c*. Once the trailing edge 8*b* of the printing plate 8 has been released from the lock-up slot 10, the suction cups 12 are deactivated to release the printing plate so that the plate cylinder 2 can be rotated in a direction indicated by arrow "C", as shown in FIG. 3*d*, until the leading edge 8*a* of the printing plate 8 is positioned substantially beneath the plate loading/unloading head 5, as shown in FIG. 4*a*. As the plate cylinder 2 rotates, it will be appreciated that, due to the inherent resiliency and weight of the printing plate 8, the printing plate 8 springs out and away from the plate cylinder 2 so that the trailing edge is left hanging downwardly and extends over the extraction bar 7, the plate 8 being supported on the plate cylinder 2 only by engagement of the lead edge 8*a* in lock up slot 9.

When the leading edge lock up slot 9 is positioned substantially beneath the plate loading/unloading head 5, the head is lowered into contact with the surface of the printing plate 8 so that the suction cups 12 come into contact with the upper surface of the printing plate 8 adjacent to their leading edge 8*a* and the suction cups 12 are activated so as to engage the printing plate 8, as shown in FIG. 4*b*. Next, the head 5 is raised so as to lift the printing plate 8 off the plate cylinder 2. However, rather than raise the plate loading/unloading head 5 to its fully raised position, it is raised only to its intermediate position in which the leading edge 8*a* of the printing plate 8 is only partially, but not entirely, lifted out of its lock-up slot 9 in the plate cylinder 2, as shown in FIG. 4*c*. Once the intermediate position is reached, the suction cups 12 are deactivated. Although deactivation of the suction cups 12 releases the printing plate 8, the leading edge 8*a* of each plate 8 does not drop back into the lock up slot 9 and is held with its leading edge 8*a* only partially inserted in the lock-up slot, as shown in FIG. 4*d*.

To complete the unloading procedure, rotation of the plate cylinder is now continued in the direction of arrow "C", as shown in FIG. 5*a*. As the plate cylinder 2 rotates, the leading edge lock up slot 9 approaches the extraction bar and the lip 14 on the extraction bar 7 engages or catches against part of the rear surface of the leading edge 8*a* of the printing plate 8 protruding from the lock up slot 9. As the plate cylinder 2 continues to rotate, the leading edge 8*a* of the printing plates 8 are lifted out of the lock up slot 9 and are hooked on the lip 14 of the extraction bar, as shown in FIG. 5*b*, thereby completely removing the printing plate 8 from the plate cylinder 2. The unloading process is now complete and the plate cylinder 2 is ready for a fresh set of printing plates 8 to be loaded thereon. The used plates 8 can be simply removed from the extraction bar 7 by manually lifting their leading edges 8*a* off the lip 14. It will be appreciated that, for example in a two around press, a first set of used plates 8 may remain hanging from the extraction bar 7 whilst another set is removed from the plate cylinder 2. The presence of a first set of used plates 8 hanging from the extraction bar 7 does not hinder the removal of a subsequent set. However, the first set of plates 8 may be manually removed prior to running the unload procedure for the second set, if preferred.

The present invention also provides means for detecting the presence of a printing plate in each printing plate position on the plate cylinder of a press which can either be a global check to see whether printing plates have been fitted to the plate cylinders of the whole press or, a local check of one or more individual print couples.

This aspect of the invention is described with reference to FIGS. 6 and 7. As mentioned previously, the plate loading/unloading head 5 includes an array of suction cups 12 which are operable to engage the printing plates 8. The array of suction cups 12 is separated into a number of distinct groups, each group being associated with a single printing plate position in a direction extending across the width of the plate cylinder 2. Each group of suction cups 12 forms part of a discrete vacuum circuit associated with each printing plate position on the plate cylinder 2.

Figure 6:
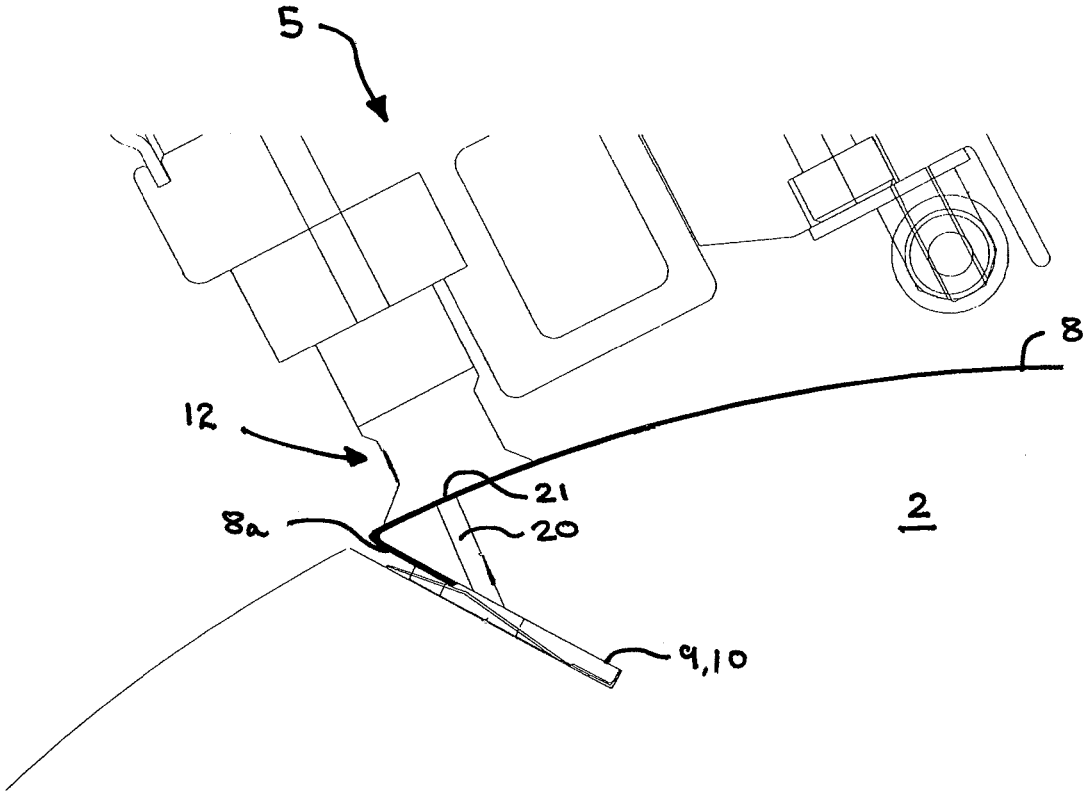
FIG. 6 is a side sectional view showing a portion of a plate cylinder and plate loading/unloading apparatus showing the vent passage in the plate cylinder for exhausting a vacuum circuit to atmosphere, with a printing plate in position between the plate cylinder and the suction cup which prevents communication of the vacuum circuit with the vent passage.
Figure 7:
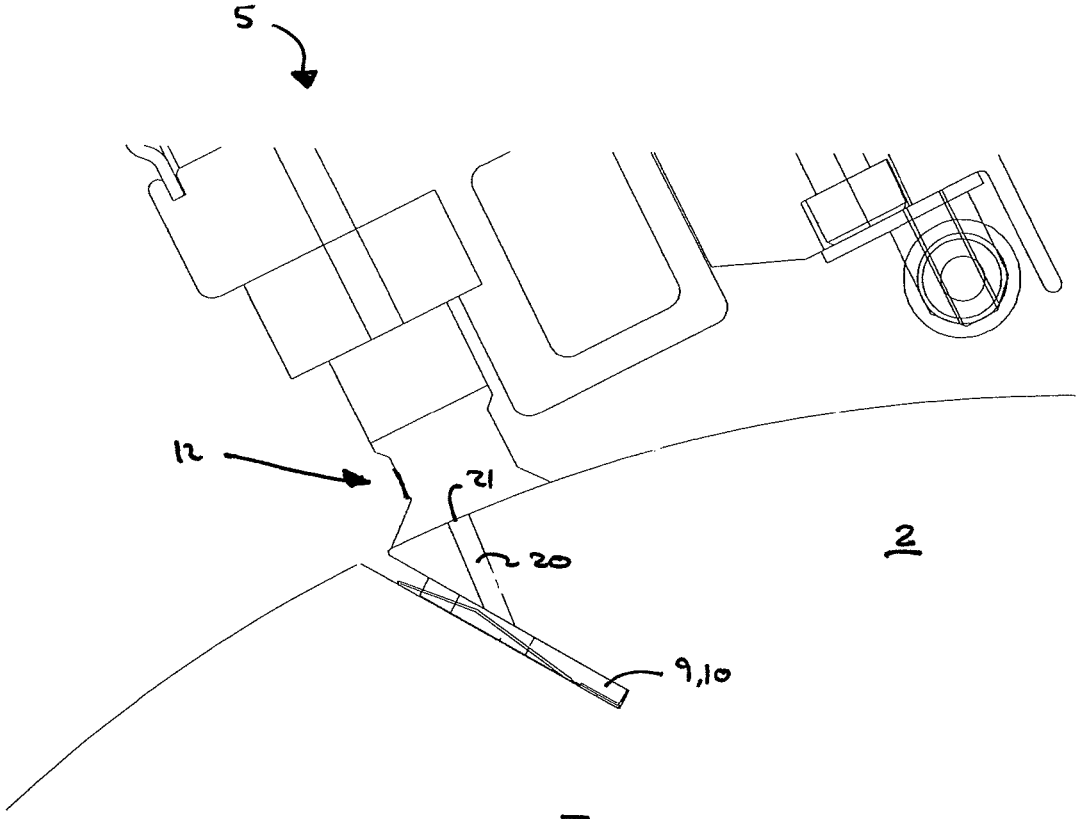
FIG. 7 is a side sectional view showing the same portion of the plate cylinder and plate loading/unloading apparatus shown in FIG. 6, without a printing plate in position on the plate cylinder between the suction cup and the vent passage so that the vent passage is in communication with the vacuum circuit to vent the vacuum circuit to atmosphere.

When a group of suction cups 12 contacts the surface of a printing plate 2 located in one printing plate position, the vacuum circuit associated with that group is closed and so its activation causes a negative pressure to be generated within that circuit which grips the printing plate 8 and enables it to be moved on movement of the support frame 11 to which the suction cups 12 are attached, as shown in FIG. 6. If, on the other hand, no printing plate 8 is present in that particular printing plate position, the suction cups 12 of that group come into direct contact with the surface of the plate cylinder 2 instead of a printing plate 8. As a result, activation of the vacuum circuit associated with that group would still cause a negative pressure to be generated within it as the vacuum circuit is closed by the surface of the plate cylinder 2 as opposed to the surface of the printing plate 8 contacted by the suction cups 12.

To prevent the generation of a negative pressure within a vacuum circuit associated with a printing plate position which is not occupied by a printing plate 8 and which is caused by contact of a group of suction cups 12 with the surface of the plate cylinder 2, the plate cylinder 2 is provided with vent passages 20 which communicate the vacuum circuit with the atmosphere when no printing plate 8 is present.

As described above, the plate cylinder 2 is indexed into a predetermined circumferential position to enable the plate loading/unloading apparatus to perform its function. Therefore, the vent passages 20 can be easily located in the plate cylinder 2 so that, when the plate cylinder 2 is in its predetermined circumferential position, the inlet 21 to the vent passages 20 is located directly beneath the region of contact of the suction cups 12 with the plate cylinder 2 so that the vacuum circuit is exhausted to the atmosphere when no printing plate 8 is present and no negative pressure is generated.

The vent passages 20 may be longitudinally extending cylindrically drilled holes which extend through to the lock up slot 9,10 in the plate cylinder 2, the lock up slot 9,10 being open to the atmosphere.

Each vacuum circuit includes a pressure sensor (not shown), switch or other means for detecting whether a negative pressure has been generated within that circuit. As an individual vacuum circuit is provided for each printing plate position, the generation of a negative pressure signifies that a printing plate 8 is located in a particular printing plate position whereas the lack of negative pressure signifies that no printing plate 8 is present in a particular printing plate position. This information can be fed back to an operator and displayed in some form on a monitor so that the operator is aware of which printing plate positions are occupied by a printing plate 8 and which are vacant without having to make a visual check on the press itself.

Effectively, in a printing press having four printing plate positions extending across the width of the plate cylinder 2, an attempt is made to generate a vacuum at each of the four printing plate positions using a discrete vacuum generating circuit associated with each position. If a printing plate 8 is present in any one of those positions, then a vacuum will be generated in the associated vacuum circuit and its presence detected using a pressure sensor. However, when a plate 8 is not present in any of the printing plate positions, no vacuum will be generated as the suction cups will be located directly above and in communication with the vent passages 20 which vent the vacuum to the atmosphere. No feedback will be provided to the control system and thus the control system will indicate that no plate 8 is fitted in this position.

It will be appreciated that the detection can be performed on a two-around plate cylinder 2. The plate cylinder 2 is moved into a first predetermined circumferential position and the aforementioned operation can be performed before the plate cylinder 2 is rotated into a second predetermined circumferential position and the operation repeated. In this case, it will be appreciated that two sets of vent passages 20 will be provided in the plate cylinder 2. Hence, the control system can map the whole press and indicate the presence of printing plates 8 at any printing plate position of any plate cylinder 2 of the press.

In a modification, rather than checking for the presence or absence of a printing plate 8 in one or more printing plate positions, a check can be made to see if a printing plate 8 has been correctly located in a printing plate position on the plate cylinder 2. In this arrangement, the plate cylinder 2 is rotated out of its predetermined circumferential position so that the suction cups 12 can be brought into contact with the plate cylinder 2 directly over the lock-up slot 9,10. If the printing plate 8 is fitted correctly, with its leading and/or trailing edge 8*a*,8*b* inserted into the lock up slot 9,10, then no vacuum will be generated as the lock up slot 9,10 is open to the atmosphere. If, however, the leading or trailing edge 9,10 of the printing plate 8 has not been correctly received within the lock up slot 9,10 and instead covers it, a vacuum will be generated when the suction cups 12 are brought into contact with the plate cylinder 2 because the vent to atmosphere through the lock up slot 9,10 is blocked by the presence of the leading or trailing edge 8*a*,8*b* of the printing plate 8. In this case, the pressure sensors provide feedback to indicate to an operator that a plate has not been fitted correctly and press start up is inhibited.

Many modifications and variations of the invention falling within the terms of the following claims will be apparent to those skilled in the art and the foregoing description should be regarded as a description of the preferred embodiments only.

What is claimed is:

1. Apparatus for removing one or more printing plates each having leading and trailing edges located in a lock-up slot in a plate cylinder of a rotary printing press, from said plate cylinder, the apparatus comprising means for gripping and partially extracting the leading edge of a printing plate from a lock up slot subsequent to extraction of the trailing edge of the printing plate from its lock up slot and, an extraction member for engaging, as the printing cylinder rotates, a portion of the leading edge of the printing plate protruding from the lock up slot following its partial extraction, to complete the removal of the printing plate from the printing cylinder and leave the removed plate, hanging by its leading edge, on the extraction member, the extraction member being separate from the means for gripping and partially extracting the leading edge of a printing plate.

2. Apparatus according to claim 1, wherein said means for gripping and partially extracting the leading edge of a printing plate from its lock up slot is also operable to extract the trailing edge of a printing plate from its lock up slot prior to partial extraction of the leading edge.

3. Apparatus according to claim 2, wherein the means for gripping and partially extracting the leading edge from its lock-up slot comprises a plate loading/unloading head which may be lowered from a raised position onto the plate cylinder, the plate loading/unloading head including gripping means for gripping printing plates located on the plate cylinder when the print loading/unloading head is lowered onto the plate cylinder.

4. Apparatus according to claim 3, wherein the plate loading/unloading head is configured so that it returns to its raised position whilst gripping printing plates on the plate cylinder so as to extract the trailing edge of the printing plate from a lock up slot.

5. Apparatus according to claim 3, wherein the plate loading/unloading head is configured so that it stops at an intermediate position when returning from its lowered position when gripping printing plates on the plate cylinder so as to partially extract the leading edge of the printing plate from a lock up slot.

6. Apparatus according to claim 5, wherein the plate loading/unloading head is configured so that the gripping means releases printing plate when the intermediate position has been reached.

7. Apparatus according to claim 6, including means for indexing the plate cylinder to a position in which the lock up slot containing the printing plate trailing edge is located substantially beneath the plate loading/unloading head for extraction of said trailing edge from the lock up slot and, indexing the plate cylinder once the trailing edge of said printing plates have been removed from said lock up slot so that the printing plate hangs down over the extraction member and its partially extracted leading edge is removed from its locked up slot by the extraction member as the lock up slot approaches and rotates past the extraction member.

8. Apparatus according to any of claim 3, wherein the gripping means comprises a plurality of suction cups.

9. Apparatus according to claim 8, wherein the plate loading/unloading head is also configured to insert the trailing edge of printing plates into a lock up slot of a plate cylinder subsequent to manual insertion of the leading edge, the plate loading/unloading head including a pusher element movable between retracted and extended positions to deflect the trailing edge of printing plates held by the suction cups toward the plate cylinder, when the plate loading/unloading head is in a raised position, so that the deflected edge slides into the trailing edge lock-up slot when the suction is deactivated or the plate loading/unloading head is lowered from its raised position back onto the plate cylinder.

10. Apparatus according to claim 9, comprising a nip point between the plate cylinder and a blanket cylinder or a pressure roller for applying pressure to the printing plates to ensure that their leading and/or trailing edges are fully inserted into the lock up slots of the plate cylinder, as the plate cylinder rotates.

11. Apparatus according to claim 1, wherein the extraction member comprises a fixed bar extending across the width of the plate cylinder adjacent to its surface.

12. Apparatus according to claim 11, wherein the fixed bar includes a lip upstanding from an edge thereof to engage the partially extracted leading edge of printing plates and fully extract the leading edge from the plate cylinder to complete the removal of the printing plates from the plate cylinder.

13. A method of removing one or more printing plates each having leading and trailing edges located in a lock-up slot in a plate cylinder of a rotary printing press, from said plate cylinder, comprising the steps of:

extracting the trailing edge of the printing plates from a lock-up slot of a plate cylinder with means for gripping and partially extracting the leading edge of a printing plate;

partially extracting the leading edge from a lock up slot of the plate cylinder and, rotating the plate cylinder so that an extraction member engages a portion of the leading edge of the printing plate protruding from the lock up slot following its partial extraction, to remove of the printing plate from the plate cylinder and leave the removed plate, hanging by its leading edge, on the extraction member, wherein the extraction member is separate from the means for gripping and partially extracting the leading edge of a printing plate.

14. A method according to claim 13, wherein the step of extracting the trailing edge of the printing plates from a lock-up slot of a plate cylinder includes the step of indexing the plate cylinder so that the lock up slot containing the trailing edge of each printing plate is located substantially beneath a plate loading/unloading head of the means for gripping and partially extracting the leading edge of a printing plate, lowering the plate loading head towards the plate cylinder, activating gripping means on the plate loading head to grip the printing plates and raising the plate loading head to extract the trailing edge of the printing plates from the lock up slot.

15. A method according to claim 14, wherein the step of partially extracting the leading edge from a lock up slot of the plate cylinder includes the steps of indexing the plate cylinder so that the lock up slot containing the leading edge of the each printing plate is located substantially beneath the plate loading/unloading head, lowering the plate loading/unloading head towards the plate cylinder, activating gripping means on the plate loading head to grip the printing plates and raising the plate loading head to an intermediate position in which the leading edge of the printing plates is partially extracted from the lock up slot.

16. A method according to claim 15, wherein the plate loading/unloading head is also configured to insert the trailing edge of printing plates into a lock up slot of a plate cylinder subsequent to manual insertion of the leading edge, the method including the steps of manually inserting the leading edge of printing plates into the leading edge lock-up slot and indexing the plate cylinder so that the trailing edge is located substantially below the plate loading/unloading head, lowering the plate loading head and activating the gripping means to grip the printing plates, raising the plate loading head and activating a pusher element to deflect the trailing edge of the printing plates towards the plate cylinder, deactivating the gripping means or lowering the plate loading head so that the trailing edge of the printing plates slide into the trailing edge lock-up slot.

17. A method according to claim 16, wherein the step of indexing the plate cylinder prior to insertion of the trailing edge of the plate cylinders into the lock up slot includes the step of pressing the manually inserted leading edge of the printing plates into their lock up slot using a blanket cylinder or a pressure roller in engagement with the plate cylinder to ensure that the leading edge is fully inserted into its lock-up slot.

18. A method according to claim 17, wherein including the step of moving the pressure roller into engagement with the plate cylinder to press the leading and/or trailing edge into the lock up slot.

19. A method according to claim 16, wherein the method includes the step of indexing the plate cylinder after insertion of the leading edge of the plate into the lock up slot so that the trailing edge passes beneath a blanket cylinder or a pressure roller in engagement with the plate cylinder to ensure the trailing edge is fully inserted into its lock-up slot.

* * * * *